US007337825B1

(12) United States Patent
Erbe

(10) Patent No.: US 7,337,825 B1
(45) Date of Patent: Mar. 4, 2008

(54) SYSTEM TO OPEN AND CLOSE DRAPES

(75) Inventor: J. Ralph Erbe, 28925 Oak Grove Dr., Elkhart, IN (US) 46514

(73) Assignee: J. Ralph Erbe, Elkhart, IN (US)

( * ) Notice: Subject to any disclaimer, the term of this patent is extended or adjusted under 35 U.S.C. 154(b) by 409 days.

(21) Appl. No.: 11/160,965

(22) Filed: Jul. 18, 2005

(51) Int. Cl.
*A47H 1/00* (2006.01)

(52) U.S. Cl. ..... 160/331; 160/321; 160/310; 318/266; 318/286

(58) Field of Classification Search ..... 160/331, 160/344, 345, 321, 310; 318/266, 286, 468
See application file for complete search history.

(56) References Cited

U.S. PATENT DOCUMENTS 1,263,628 A * 4/1918 Vallen ..... 160/331
3,438,423 A * 4/1969 Melull et al. ..... 160/331
4,548,250 A * 10/1985 Meharg et al. ..... 160/331
4,775,039 A * 10/1988 Sunakawa ..... 477/11
4,958,112 A * 9/1990 Zerillo ..... 318/280
4,995,442 A * 2/1991 Marzec ..... 160/331
5,371,447 A * 12/1994 Boss ..... 318/265
5,598,000 A 1/1997 Popat
5,848,634 A 12/1998 Will et al.
5,889,377 A * 3/1999 Mao ..... 318/466
6,100,659 A 8/2000 Will et al.
6,201,364 B1 3/2001 Will et al.

* cited by examiner

*Primary Examiner*—Blair M. Johnson
(74) *Attorney, Agent, or Firm*—Leo H. McCormick, Jr.

(57) ABSTRACT

An electric motor moves drapes on a carrier by a cord wound on a sheave attached to a shaft thereof. The motor is attached to a housing along with a second shaft. The second shaft has an arm on an end thereof and carries a disc with first and second cam surfaces thereon and an axial projection. An arcuate slot on an end cap receives the projection on the disc. In response to an actuation signal, a control activates the motor causing the shaft and sheave to rotate and linearly move the cord and drapes. A limit member on the cord engages the arm and rotates the second shaft causing the first cam to close a first switch and cancel the actuation signal while the second cam closes a second switch such that the rotational direction of the shaft is reversed on receipt of a next actuation signal.

10 Claims, 3 Drawing Sheets

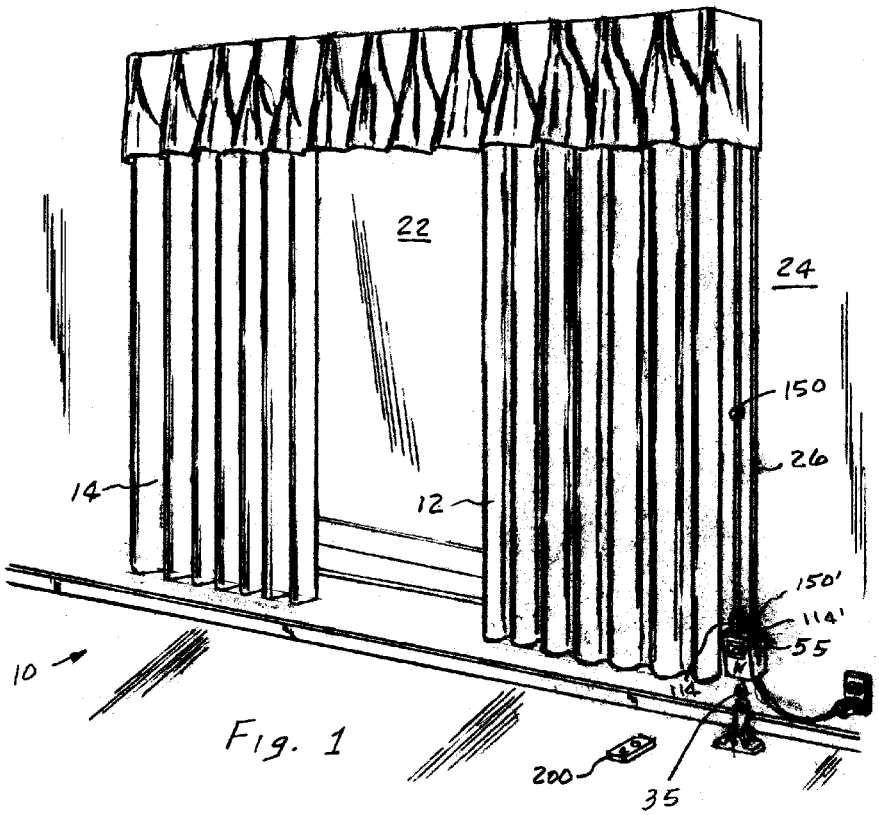
Fig. 1
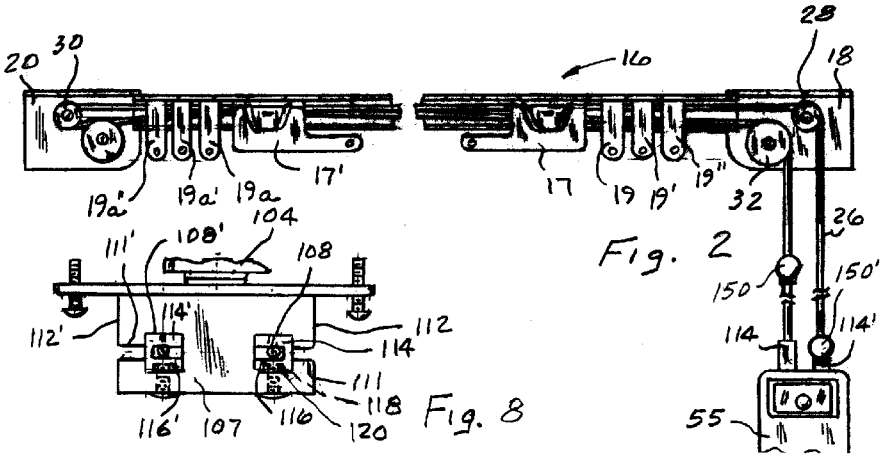
Fig. 2
Fig. 8

SYSTEM TO OPEN AND CLOSE DRAPES

This invention relates to a system that includes an electric motor and switch apparatus through which a drape arrangement for a window is opened and closed from a remote location.

BACKGROUND OF THE INVENTION

A home owner often installs window shades to provide privacy from the outside into a room. Conventional reelable window shades are normally installed and may be vertically moved between opened and closed positions change an amount of light and the view into a room. In such window shades a vertical movement is achieved by manually tightening a spring arrangement or in a mechanism system by activating a motor to moves the shade in a manner as disclosed in U.S. Pat. Nos. 5,848,634; 6,100,659 and 6,201,364. The motor for the mechanism systems function in an adequate manner to control a desired position for a window shade however the motor only needs to raise the shade in an upward vertical direction as a weight bar attached to the shade primarily acts to lower the shade from a raised location.

Some home owners may desire to have drapes places around windows rather that shades to meet a decorating scheme in a room. The drapes are often attached to a carrier that is moved on a track by a cord arrangement. In the cord arrangement a person pulls on a first cord to open the drapes and on a second cord to close the drapes. This type of cord arrangement is typical; however, some owners may desire to mechanize the opening and closing of drapes.

SUMMARY OF THE INVENTION

The present invention allows a person to supply an actuation signal to a transponder that is communicated to an ecu from a receiver that such that an electric motor moves a cord to open and close a drape arrangement from a remote location.

In more particular detail, the system includes a carrier on which drapes are attached that is connected to and moved by a continuous cord that extends from a first sheave on a first bracket, around a second sheave on a second bracket, back to a third sheave on the first bracket and around a fourth sheave retained in a housing for a tensioning member before returning to the first sheave. The housing for the tensioning member includes a support member on which the motor is located such that a first shaft thereon extend through the support member to receive and carry the fourth sheave. A toggle control for providing an input signal that changes the direction of the electric motor has a second shaft that is located in an axial bore in the support member and aligned with the shaft of the electric motor. First and second radial arms on the toggle control are located in a perpendicular relationship with a projection attached to the first end of the second shaft while a disc is retained on the second end of the second shaft by an end cap. The disc has a peripheral surface with at least a first cam and a second cam thereon and an axial pin that is received in an arcuate slot on the end cap. A spring attached to the support member acts on the projection for sequentially urging the one of either a first or second radial arms toward a corresponding first or second rest position. A first switch that connected to a receiver and a source of electricity is secured to the support member such that a first roller thereon is located on the first cam on the disc. A second switch that is connected to the electric motor and the source of electricity is also secured to the support member such that a second roller thereon is located on the second cam on the disc. First and second plungers that have slots therein through which the cord passes are attached to the support member to have limited vertical movement are respectively connected to the first and second arms on the second shaft. An electronic control unit retained on the support member is connected to the first switch, the second switch, the electric motor and a source of electrical energy. In response to an input signal from a remote transponder, a receiver activates the electronic control to selectively supplying electricity to electric motor causing the first shaft and fourth sheave to rotate in a first direction such that the continuous cord is moved and as a result the carrier linearly moves between the first and second brackets. Movement of the cord continues until an adjustable stop attached to the cord engages and moves the first plunger and first radial arm to rotate the second shaft. As the second shaft rotates the axial pin on the end cap engages and thereafter rotates the disc to change a relationship between the first cam and first roller causing the first switch to send a signal to the receiver to cancel the input signal from the transponder and to change a relationship between the second cam and second roller causing the second switch to send a signal to the electric control such that on receipt of a subsequent input signal from the transponder the rotational first direction of the motor is reversed and as a result on activation of the electric motor, the cord and carrier move in a second direction.

An advantage of the invention resides in the ability of a reversible electric motor to linearly open and close a drape through the movement of a continuous cord carried by a sheave on a shaft of the motor.

The present invention offers a system of controlling the opening and closing drapes that are associated with an opening through a signal supplied by a person through a transponder to a receiver associated with an electric motor that moves a continuous cord connected to a carrier on which the drapes are attached.

BRIEF DESCRIPTION OF THE DRAWINGS

FIG. 1 is a front perspective view of a window adorned by a drape arrangement that is opened and closed upon the activation of an electric motor from a remote location according to the present invention;

FIG. 2 is a schematic illustration of a carrier and continuous cord for the drape arrangement of FIG. 1;

FIG. 8 is a view taken along lines 8-8 of FIG. 5 showing openings in a guide and first and second plungers through which the cord passes to engage a sheave retained on the shaft of the electric motor for moving the cord.

DETAILED DESCRIPTION

Figure 3:
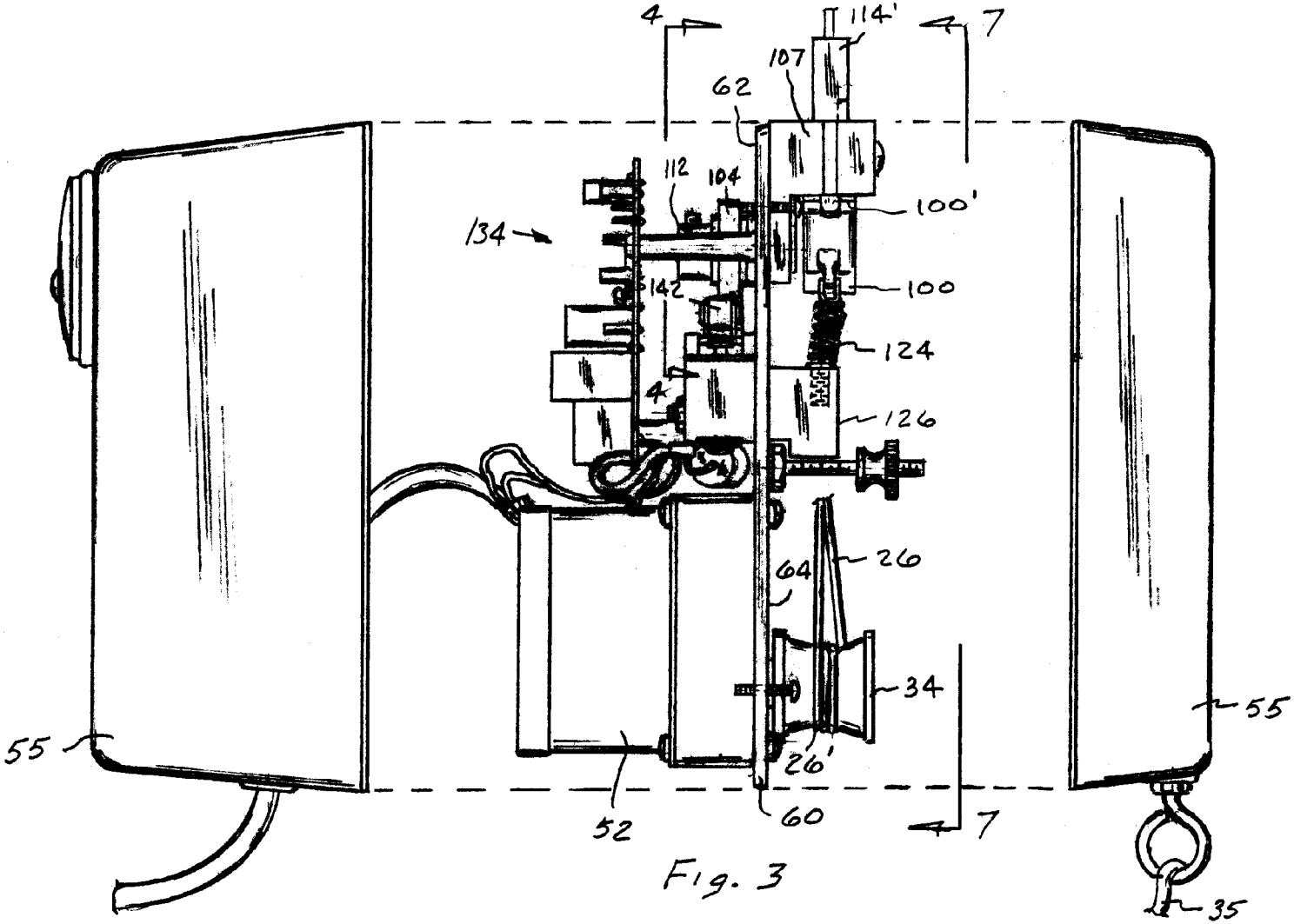
FIG. 3 is an exploded side view of a housing and support member for the electric motor and switch apparatus of FIG. 1.
Figure 4:
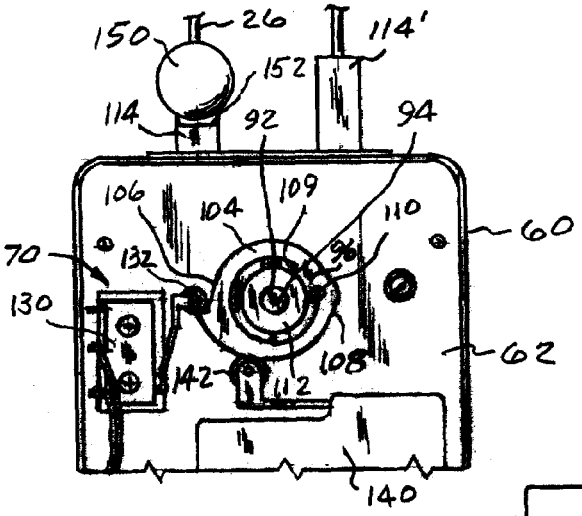
FIG. 4 is a schematic view taken along lines 4-4 of FIG. 3 showing the position for the switch apparatus for operating the electric motor in a first rotational direction.
Figure 6:
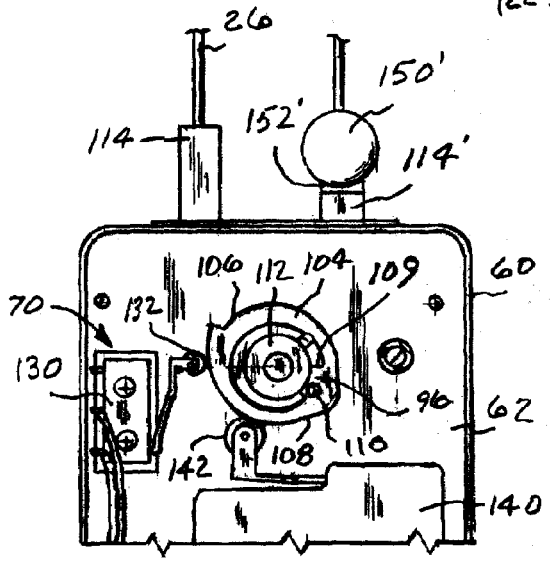
FIG. 6 is a schematic view taken along lines 4-4 of FIG. 3 showing the position of the switch apparatus for operating the electric motor in a second rotational direction.
Figure 5:
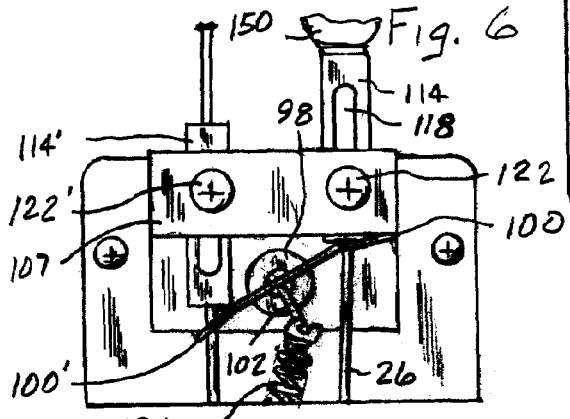
FIG. 5 is a schematic view taken along lines 5-5 of FIG. 3 showing the position for a toggle member when the electric motor rotates in the first rotational direction.

The drape arrangement 10 shown in FIG. 1 includes an electric motor and control means according to the present invention for opening and closing drapes in response to an input supplied by a person to a transponder 200. The drape arrangement 10 includes a first panel 12 and a second panel 14 that are attached to a horizontal carrier 16 that extends between a first bracket 18 and a second bracket 20 that are located adjacent an window opening 22 in a wall 24. The carrier 16 as best shown in FIG. 2 includes a continuous cord 26 that extends from a first sheave 28 on the first bracket 18, around a second sheave 30 on the second bracket 20, back to a third sheave 32 on the first bracket 18 and around a fourth sheave 34 that is retained on a shaft 50 of an electric motor 52 retained in housing 55 before returning to the first sheave 28. The carrier 16 includes a first attachment 17 and associated clips 19, 19', 19" for panel 12 and a second attachment 17' and associated clips 19*a*, 19*a'*, 19*a"* for panel 14 that are attached to cord 26 such that movement of the cord 26 in a first direction moves the first 17 and second 17' attachments toward each other while movement of the cord 26 in an opposite second direction moves the first attachment 17 away from the second attachment 17'. A spring 35 is attached to housing 55 and the floor to apply a force to instill a desired force or tension in the cord 26.

In more particular detail, the housing 55 includes two parts that encloses a support member 60 on which the electric motor 52, switch apparatus 70 and associated controls are mounted in a manner as best illustrated in FIGS. 3-8. The a support member 60 has a first side 62 and a second side 64 such that the electric motor 52 is located on the first side 62 with a shaft 50 that extends through a first bore therein to the second side 64 for receiving the fourth sheave 34. The direction of rotation of shaft 50 and sheave 34 thereon rotate is a function of the position of a toggle member 90 that is mounted on the support member 60. The toggle member 90 has a shaft 92 that is located in a second bore in the support member 60 and is aligned with a first bore such that a first end 94 thereof is located on the first side 62 and a second end is located on the second side 64 of the support member 60. An end member 98 that is attached to the second end of the shaft 92 has first 100 and second 100' radial arms that extend there from and a projection 102 that extends along a plane perpendicular to the first 100 and second 100' radial arms. A disc 104 is located on the shaft 92 between the first end 94 and first side 62 of the support member 60, the disc 104 has a peripheral surface with a first cam 106 and a second cam 108 thereon and an axial pin 110 that extends away from the first side 62. An end cap 112 that is secured to the first end 94 of shaft 92 to retain the disc 104 adjacent the first side 62 of the support member 60 has an arcuate slot 96 for receiving the axial pin 110 on disc 104.

Figure 7:
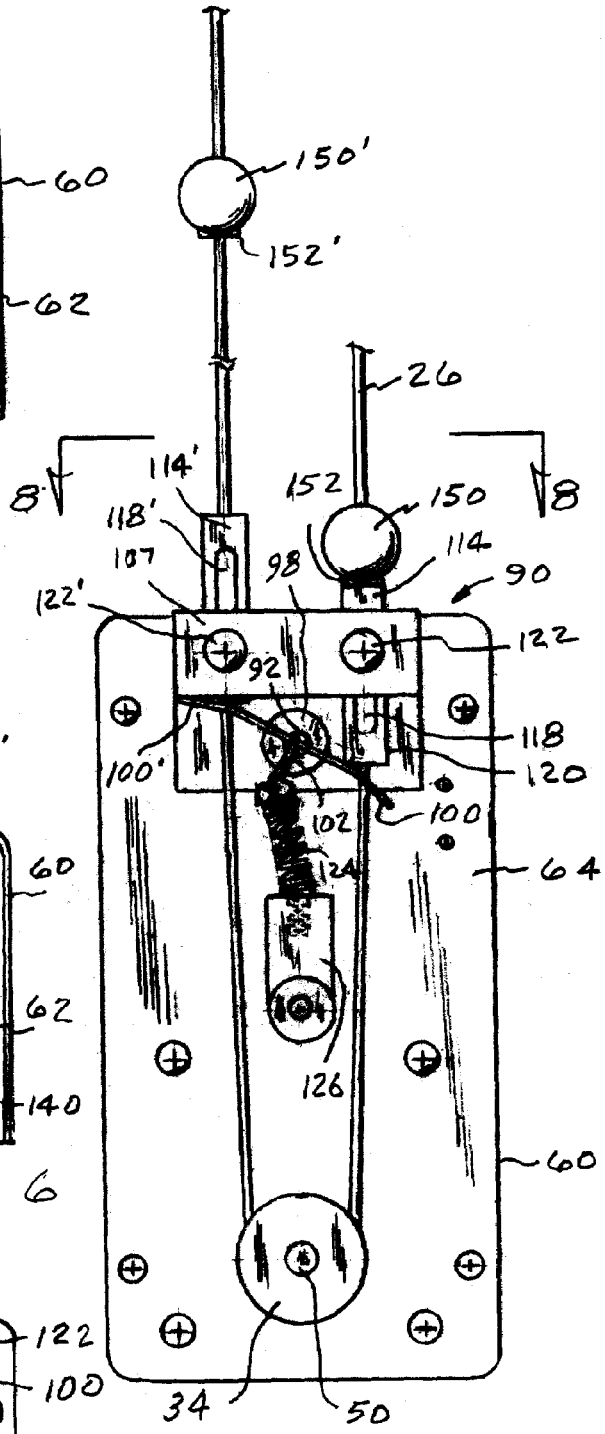
FIG. 7 is a schematic view taken along lines 5-5 of FIG. 3 showing the position of the toggle member when the electric motor rotates in the second rotational direction.

A guide 107, that is attached to the support member 60 for assisting in maintaining the alignment of cord 26 with the sheave 34 has a first vertical rectangular opening 108 with a slot 111 thereon on a first side 112 and a complimentary second vertical rectangular opening 108' with a slot 111' there on a second side 112' as illustrated in FIGS. 3 and 7. The first opening 108 receives a first rectangular plunger 114 while the second opening 108' receives a second rectangular plunger 114'. Rectangular plungers 114, 114' each have a vertical slot 116, 116' there through such that U-shaped members are created and a groove 118,118' along a face 120. After cord 26 passes through slots 111,111' in guide 107 it is located in rectangular openings 108,108' and then plungers 114,114' are respectively inserted in the rectangular openings 108,108' such that the U-shape thereof locks the cord 26 in the rectangular opening 108,108' as seen in FIG. 8. Set screws 122,122' are attached to the guide 107 that respectively extends into grooves 118,118' such that the plungers 114,114' are fixed to the guide 107 but have restricted vertical movement that is a function to the length of grooves 118,118'.

A positioning spring 124 that is connected to the support member 60 has a first end that is connected to projection 102 and a second end that is secured to the support member 60 by clip 126. The spring 124 acts on the projection 102 such that radial arm 100 engages plunger 114 and radial arm 110' engages plunger 114' to sequentially holds the bottom of groove 118 against set screw 122 and the top of groove 118' against set screw 122' as illustrated in see FIG. 6 or the top of groove 118 against set screw 122 and the bottom of groove 118' against set screw 122'.

The switch apparatus 70 includes a first switch 130 and a second switch 140. The first switch 130 is attached to the support member 60 is connected to a receiver on circuit board 134 and a source of electricity. The first switch 130 is responsive to the position of a first roller 132 on the first cam 106 on disc 104 and controls the activation of the ecu in response to an actuation signal from the transponder 200 as received by the receiver. The receiver is of a known design and upon receipt of the actuation signal allows electricity to be communicated to the ecu on circuit board 134.

The second switch 140 is attached to the support member 60 and connected to the ecu for selecting the rotational direction of the electric motor 52. The second switch 140 is responsive to the position of a second roller 142 on the second cam 108 on the disc 104 and functions to provide a signal to the ecu such that the rotational direction of the electric motor 52 is sequentially reversed.

The distance that the first 12 and second 14 panels of the drape arrangement 10 travel is determined by first 150 and second 150' limit members that are attached to cord 26. The first limit member 150 is controlling when sheave 34 is rotating in a first direction while the second limit member 150' is controlling when sheave 34 is rotating in a second or opposite direction. The first limit member 150 that includes a first adjustable stop 152 that is selectively secured to the continuous cord 26 and the first plunger 114 that is retained in guide 107 on the second side 64 of the support member 60. Movement of the plunger 114 by the stop 150 causes the first radial arm 100 to move and rotate shaft 92 and activate switch 130 to cancel or nullify the actuation signal from the transponder 200. Similarly, the second limit member 150' includes a second adjustable stop 152' that is selectively secured to the continuous cord 26 and the second plunger 114' retained in guide 107 on the second side 64 of the support member 60. Movement of the plunger 114' by the stop 150' causes the first radial arm 100' to move and rotate shaft 92 and activate switch 130 to cancel or nullify the actuation signal from the transponder 200.

The electronic control unit is mounted on circuit board 134 that is mounted on the support member 60. The ecu is connected to the first switch 130, the second switch 140, the source of electricity and the electric motor 52. The supply of electricity to the electric motor 52 is under the control of the ecu such that electricity is selectively supplied to electric motor 52 in response to an actuation signal from a transponder 200 as received by the receiver. Rotation of the shaft 50 of the electric motor 52 causes the fourth sheave 34 to rotate in either a first direction or a second direction. Cord 26 is wound around sheave 34 several times normally from 2 to 4 times and as a result has sufficient pulling force to linearly move the carrier 16 with respect to the first 18 and second 20 brackets. Movement of carrier 16 continues until either the first adjustable stop 150 engages and moves the first plunger 114 and first radial arm 100 or the second adjustable stop 150' engages and moves the second plunger 114' and second radial arm 100' to rotate shaft 92 such that the end cap 112 engages the axial pin 110 on thereafter rotates disc 104 to change a relationship between cam 106 and roller 132 such that an actuation signal received by the receiver is cancelled and to changes a relationship between the second cam 108 and second roller 142 such that the input signal supplied the ecu thereafter terminates the communication of electricity to the electric motor 52 and polarity of the electricity motor 52 is changed such that on receipt of a next actuation signal from the transponder 200 and shaft 50 and sheave 34 rotates in an opposite direction along with the cord 26 and carrier 16.

MODE OF OPERATION

When a person desires to close or open panels 12 and 14 in the drape arrangement 10 shown in FIG. 1, an input is supplied to a remote transponder 200 that sends an actuation signal that is received by a receiver located on the circuit board 134. The receiver acting through the first switch 130 brings the ecu on line and through the second switch 140 supplies the electric motor 52 with electricity causing shaft 50 and sheave 34 thereon to rotate in a first direction. As sheave 34 rotates, the turns 26' thereon pull cord 26 from sheave 32 causing panel 12 to linearly move toward bracket 18 and panel 14 to linearly move toward bracket 20. Movement of cord 26 continues until stop 150 engages plunger 114 and moves plunger 114 from a position shown in FIG. 5 to a position shown in FIG. 7. As plunger 114 moves toward the position shown in FIG. 7, arm 100 acts on and rotates shaft 92 and end cap 112. The rotation of shaft 92 is opposed by spring 124 until a position is reached where projection 102 is past the radial center of shaft 92 and then spring 124 pushes arm 100' toward plunger 114' and at the same time the bottom of slot 109 engages projection 110 on disc 104 causing disc 104 to rotate from a position shown in FIG. 4 to a position shown in FIG. 6. As disc 104 rotates, the relationship between roller 132 on the first switch 130 is changes with respect to cam surface 106 such that the actuation signal from the transponder to the receiver is terminated and the relationship between roller 142 and cam surface 108 is changed from that illustrated in FIG. 4 to that illustrated in FIG. 6 such that switch 140 supplies the ecu with a signal to terminate the electricity supplied to the electric motor 52 and change the polarity of the electric motor 52 such that in response to a next actuation signal from the transponder, the rotational direction of the electric motor 52 is reversed and the linear movement of the carrier 16 is in an opposite direction to close the panels 12 and 14 in the drape arrangement.

What is claimed is:

1. A system for opening and closing drapes that are retained on a horizontal carrier that is located between a first bracket and a second bracket that is attached to a wall, said carrier including a continuous cord that extends from a first sheave on the first bracket, around a second sheave on the second bracket, back to a third sheave on the first bracket and around a fourth sheave associated with a tensioning member before returning to the first sheave, said system further including an electric motor and switch apparatus consisting of:

a support member having a first side and a second side;

a motor secured to said first side of said support member with a first shaft that extends through the support member to said second side, said fourth sheave being attached to said first shaft and located on said second side of said support member;

a toggle member having a second shaft that extends through said support member with a first end located on said first side of said support member and second end located on said second side of said support member;

first and second radial arms attached to said second end of said second shaft of said toggle member;

a projection that extends from said second shaft along a plane perpendicular to said first and second radial arms;

a disc retained on said second shaft and located on said first side of said support member, said disc having a peripheral surface with at least a first cam and a second cam thereon and an axial pin that extends away from the first side;

an end cap secured to said second shaft, said end cap having an arcuate slot for receiving said axial pin on said disc;

a spring connected to said support member and acting on said projection for sequentially urging said second shaft toward one of either a first rest position or a second rest position;

a first switch secured to said support member and having a first roller located on said first cam on said disc, said first switch being connected to a receiver and a source of electricity;

a second switch secured to said support member and having a second roller located on said second cam on said disc, said second switch being connected to the electric motor and the source of electricity;

a first limit member including a first adjustable stop secured to said continuous cord and a first plunger slideably retained on said second side of said support member and connected to said first radial arm;

a second limit member including a second adjustable stop secured to said continuous cord and a second plunger slideable that is retained on said second side of said support member and connected to said second radial arm; and electronic control means connected to said first switch, said second switch and said electric motor for selectively supplying electricity to electric motor in response to a first actuation signal from a transponder is communicated to the receiver and said fourth sheave is initially rotated in a first direction causing said continuous cord to linearly move said carrier with respect to said first and second brackets until said first adjustable stop engages and moves said first plunger and said first radial arm causing said second shaft to rotate such that said axial pin on said end cap engages and thereafter rotates said disc to change a relationship between said first cam and first roller such that said input signal from the receiver is cancelled and to change a relationship between said second cam and second roller such that a signal is supplied to said electronic control means such that the operational rotation of the electric motor is reversed on receipt of a next actuation signal from the transponder and as a result the cord and carrier move in an opposite direction.

2. The system as recited in claim 1 wherein said second limit member engages said second plunger to rotate said second shaft and said disc to change a current relationship between said first roller and first switch and said second roller and second switch such that a second subsequent input signal from the transponder the operational rotation of the electric motor is reversed to the first rotational direction.

3. The system as recited in claim 1 further being characterized in said first and second limit members provide for a delay in the termination of electricity to said electric motor to assure that the movement of the cord corresponds to a desired linear movement of the carrier.

4. The system as recited in claim 2 wherein said first and second adjustable stops may be moved on said cord to establish a desired linear movement of said carrier.

5. The system as recited in claim 3 wherein said first and second plungers do not interfere with movement of said cord with respect to said fourth sheave.

6. The system as recited in claim 4 wherein said cord is wound about said fourth sheave at least two turns to define a minimum for linearly moving said carrier.

7. The system as recited in claim 5 wherein said cord is wound about said fourth sheave a maximum of four turns to define a maximum force for linearly moving said carrier.

8. A system for opening and closing drapes that are retained on a horizontal carrier that is located between a first bracket and a second bracket, said carrier including a continuous cord that extends from a first sheave on the first bracket, around a second sheave on the second bracket, back to a third sheave on the first bracket and around a fourth sheave associated with a tensioning member before returning to the first sheave, said system further including an electric motor and switch apparatus consisting of:

a support member;

a motor secured to said support member having a first shaft on which said fourth sheave is located;

a toggle member attached to said support member and including a second shaft with first and second radial arms attached to said toggle member, a projection that extends along a plane that is perpendicular to said first and second radial arms, a disc retained on said second shaft having a peripheral surface with at least a first cam and a second cam thereon and an axial pin, an end cap secured to said second shaft with an arcuate slot for receiving said axial pin on said disc, and a spring connected to said support member and acting on said projection for sequentially urging said second shaft toward one of either a first rest position or a second rest position;

a first switch secured to said support member and having a first roller located on said first cam on said disc, said first switch being connected to a receiver and a source of electricity;

a second switch secured to said support member and having a second roller located on said second cam on said disc, said second switch being connected to the electric motor and the source of electricity;

limit means including an adjustable stop secured to said continuous cord and a plunger slideably retained on said support member and connected to said first radial arm; and electronic control means connected to said first switch, said second switch and the electric motor for selectively supplying electricity to the electric motor in response to a first actuation signal from a transponder to the receiver for activating the electric motor to rotate said fourth sheave in a first direction causing said continuous cord to linearly move said carrier with respect to said first and second brackets until said first adjustable stop engages and moves said first plunger and said first radial arm to rotate said second shaft such that said axial pin on said end cap engages and thereafter rotates said disc to change a relationship between said first cam and first roller and send a termination signal to the receiver to cancel the input signal from the transponder and to change a relationship between said second cam and second roller and send a reversing signal to said electronic control means such that on receipt of a next actuation signal from the transponder the rotational first direction of the motor is reversed and the cord and carrier move in a second direction.

9. The system as recited in claim 8 wherein the linear movement of the carrier is adjusted by moving said limit means on the cord.

10. A system for moving drapes retained on a carrier by movement of a cord comprising:

a sheave on a first shaft of an electric motor that is secured to a housing, said sheave receiving a plurality of winds of the cord;

a second shaft retained by the housing, said second shaft having an arm on an end thereof;

a disc carried by the second shaft having first and second cam surfaces thereon and an axial projection;

an cap attached to the second shaft having an arcuate slot for receiving the projection on the disc to position said disc adjacent the housing;

a first switch having a first roller that is located in said first cam surface of said disc and being connected to a receiver;

a second switch having a second roller that is located on said second cam surface of said disc and being connected to said electric motor;

stop means attached to said cord; and a control unit connected to said first switch, second switch, electric motor and a source of electrical energy, said receiver being responsive to an actuation signal from a transponder such that the first switch provides said control unit with an input and said control unit thereafter allows electricity to be supplied to the electric motor causing said first shaft and said sheave to rotate and pull on said cord to linearly move the carrier until said stop means engages the arm on said second shaft and rotate said second shaft and said first cam sufficiently to close said first switch and nullify the actuation signal and move said second cam to close said second switch such that the rotational direction of said first shaft is reversed on the receipt of a next actuation signal.

* * * * *